United States Patent [19]

de Lama et al.

[11] 3,978,905

[45] Sept. 7, 1976

[54] CANVAS STRETCHER FRAME

[76] Inventors: Alberto de Lama, P.O. Box 17, Chicago, Ill. 60690; Joseph Cano, 2033 W. Charleston St., Chicago, Ill. 60647

[22] Filed: Sept. 2, 1975

[21] Appl. No.: 609,302

[52] U.S. Cl. ..... 160/378; 38/102.91

[51] Int. Cl.[2] ..... B44D 3/18

[58] Field of Search ..... 160/374.1, 378, 379, 160/381, 371, 328; 38/102.91; 24/248 FS; 26/62 B

[56] References Cited

UNITED STATES PATENTS

| | | | |
|---|---|---|---|
| 2,149,985 | 3/1939 | Tepper | 160/374.1 |
| 2,218,451 | 10/1940 | Heyne | 160/378 X |
| 3,126,332 | 3/1964 | Salete | 160/378 X |
| 3,273,497 | 9/1966 | Rosema et al. | 160/378 X |
| 3,485,165 | 12/1969 | Hughes | 160/378 X |
| 3,497,079 | 2/1970 | Kulwiec | 160/381 X |
| 3,534,490 | 10/1970 | Herbert | 403/401 X |

*Primary Examiner*—Philip C. Kannan
*Attorney, Agent, or Firm*—Charles F. Pigott, Jr.

[57] ABSTRACT

A rigid non-expandable frame for holding an artist's canvas or the like, has permanently coupled thereto a plurality of independently operable clamps. The clamps have guides adapted to slide along the frame and include adjustable jaws for grasping the canvas. Each clamp includes a manually operable member with one end positioned against the frame for moving the clamp inward of the frame to selectively permit localized stretching and contraction of the canvas.

14 Claims, 9 Drawing Figures

CANVAS STRETCHER FRAME

BACKGROUND OF THE INVENTION

This invention relates to a frame assembly for holding a stretchable web such as an artist's canvas and the like, and more particularly to a device for selectively adjusting the tension of the stretchable web.

Artist's canvases have a tendency to expand and contract with changes of temperature and relative humidity causing cleavage, losses in paint film and the formation of draws along the edges and corners of the painting. In an effort to alleviate this problem, serrated stretcher frames of the type found in U.S. Pat. No. 3,127,695 and expandable stretcher frames of the type found in U.S. Pat. No. 3,625,274 have been provided. These stretcher frames, however, do not permit pinpoint stretching or slackening of certain sections of the canvas without disturbing other sections of the canvas. Furthermore, expandable stretcher frames change their dimensions, losing dimensional stability, during stretching and expansion making it difficult to remount a painting in the original frame.

Non-expandable frames of the type found in U.S. Pat. Nos. 3,126,332 and 3,485,165 have been provided for one-sided stretching of sifting cloths and silk-screens, without disturbing other sides of the web and are more desirable than expandable frames, because they remain dimensionally stable so that the outer dimensions of the frame remained unchanged during stretching. These non-expandable frames, however, do not permit sections along one side of the web to be stretched or loosened, without concomitantly stretching or loosening other sections along the same side of the web, which might not need any alterations and could be damaged by any expansion or contraction. Stated in other terms, these prior art non-expandable frames do not permit localized stretching and contraction, and like the expandable frames do not permit the traditional method of stretching, whereby the canvas is stretched from the center side first and alternatively rotated and stretched left and right for even fabric stretching.

It is therefore an object of this invention to provide an improved dimensionally stable non-expandable stretcher frame which permits traditional canvas stretching and subsequent localized web stretching and contraction with a predetermined number of selectively spaced clamps.

The foregoing and other objects and advantages will be apparent from the following description and appended claims taken in conjuntion with the accompanying drawings.

SUMMARY OF THE INVENTION

There is provided by virtue of this invention a frame assembly which is constructed and arranged to permit localized grasping, stretching and contraction of a stretchable web. The frame assembly includes (1) a plurality of elongated frame members with abutting mitered end portions cooperatively positioned to define a polygonal-shaped structure, and (2) a plurality of clamps permanently coupled to the polygonal-shaped structure. Each of the frame members has a cross-sectional configuration defining an elongated clamp-receiving channel.

The clamps are each independently operable and include: (a) guide means for slidably engaging the clamp-receiving channel; (b) jaw means for grasping the stretchable web, (c) coupling means connecting the jaw means to the guide means and spaced inward of the frame members within the area bounded by the polygonal-shaped structure, and (d) manually operable means abutting the polygonal-shaped structure and operatively connected to the coupling means for selectively adjusting the tension of the web.

A more detailed explanation of the invention is provided in the following description and appended claims taken in conjunction with the accompanying drawings.

DETAILED DESCRIPTION OF THE ILLUSTRATIVE EMBODIMENT

Figure 1:
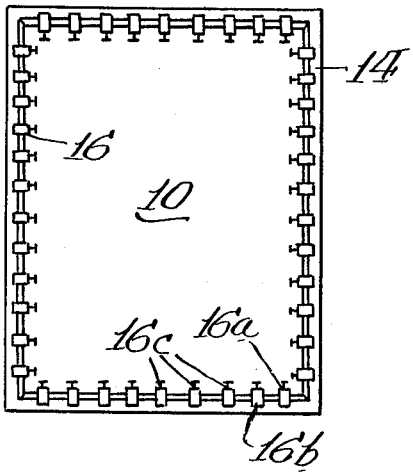
FIG. 1 is a perspective view of the back side of a stretcher frame assembly in accordance with principles of the present invention.

Referring to the drawings, a stretcher frame assembly 10 is provided for holding a stretchable web 12, such as an artist's canvas or the like. The stretcher frame assembly includes: (1) a rectangular picture-frame structure 14, which when assembled is mitered, rigid and non-expandable, and (2) a plurality of independently operable clamps 16 which are permanently and securely coupled to the assembled picture-frame structure.

The Frame Structure

Figure 5:
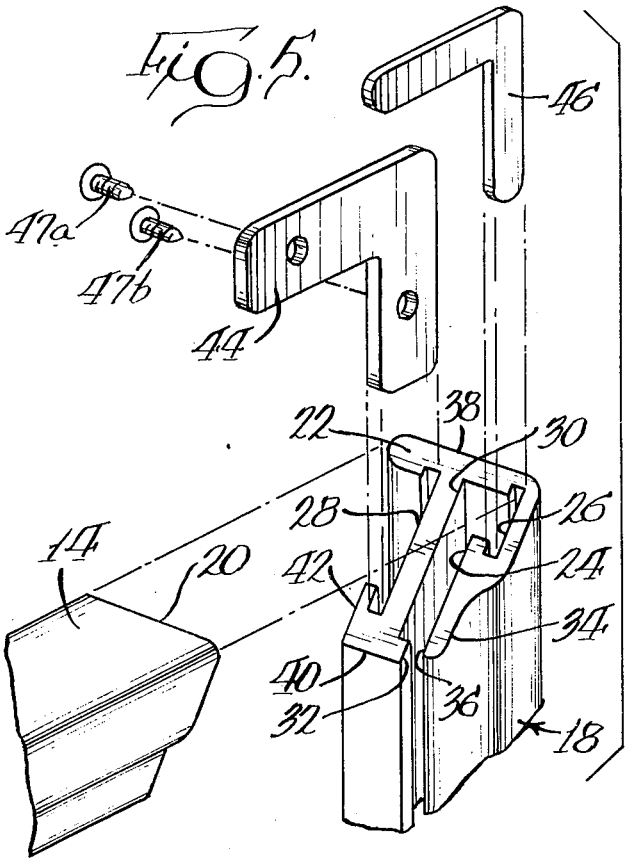
FIG. 5 is an exploded perspective view of one corner of the frame structure.

In the preferred embodiment, the rectangular picture frame structure 14 includes four elongated frame members, such as 18, formed of metal, such as extruded aluminum, with a profile or cross-sectional configuration as shown in FIG. 5. The ends 20 and 22 of each frame member are mitered at a 45° angle and are positioned in abutting cooperative relationship with adjacent frame members so as to define the perpendicular corners of the rectangular frame structure.

Each frame member 18 is constructed and arranged to define: (1) a clamp-receiving channel 24 contiguous with a small angle-receiving channel 26 and (2) a large angle-receiving channel 28. A transverse section 30 separates the clamp-receiving channel 24 from the large angle-receiving channel 28 and is shaped to include a forwardly-extending finger 32 which cooperates with a concave lip member 34 to define the mouth 36 of the clamp-receiving channel. The mouth 36 of the clamp-receiving channel is of a smaller size and dimension than the main body of the clamp-receiving channel 24 to prevent removal of the clamps 16 once the rectangular picture frame structure is assembled.

The concave lip member 34 allows minimal contact with the back of the canvas to prevent visible marks on the painting surface of the canvas which could happen upon contact of the frame and canvas as pressure is exerted in the process of priming the canvas or applying paint film upon the canvas. The large angle-receiving channel 28 is normally hidden from view behind the concave lip member on the underside of the picture frame structure. The outer side wall 38 of each frame member 18 defines the depth or thickness of the picture frame structure and may be viewed from the sides of the stretcher frame assembly. The inner side wall 40 of each frame member is positioned toward the center of the picture frame structure and functions as an abutment wall for the clamps 16. The inner side wall includes the forwardly-extending finger 32 and a rearwardly-extending finger 42.

The corners of the picture frame structure 14 each include a large perpendicular angle bracket 44 positioned within the large angle-receiving channel 28 and a small perpendicular angle bracket 46 positioned within the small angle-receiving channels. The large bracket is bolted or screwed such as by screws 47*a* and 47*b*, into the frame member 18 to rigidify the picture frame structure. The brackets are similar in appearance to the locking joints of the frame structure disclosed in U.S. Pat. No. 3,534,490.

The Clamps

Referring now to the clamps 16, each clamp has an elongated guide 48 adapted to slide along the clamp-receiving channel 24. The outer end of the guide 48 is shaped to define a lip 50 of a greater size and dimension than the mouth 36 of the clamp-receiving channel. During assembly of the picture frame structure 14, guide 48 is inserted into the clamp-receiving channel from the end of the frame member 18, so that when the stretcher frame 10 is assembled, lip 50 is confined within the body of the clamp-receiving channel 24 to prevent the clamp from being removed from the assembled stretcher frame or coming loose and damaging the canvas.

Extending from the inner end of the guide 48 opposite lip 50 is a coupling member 52, which is longer than the frame member's inner side wall 40 and is centrally threaded to receive a thumb-screw 53. The rearward end of the coupling member is integrally connected to a jaw member 54 with spaced serrated bifurcated fingers 56 and 58, for grasping the stretchable web 12. The jaw member is threaded to receive a jaw-screw 60 for varying the spacing between the bifurcated fingers when it is desired to remove or insert the stretchable web and to adjust to different canvas thicknesses.

Figure 3:
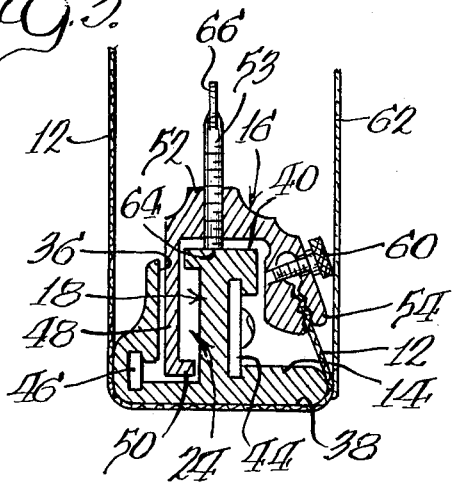
FIG. 3 is a cross-sectional view of a clamp and frame member taken substantially along line 3—3 of FIG. 2.
Figure 2:
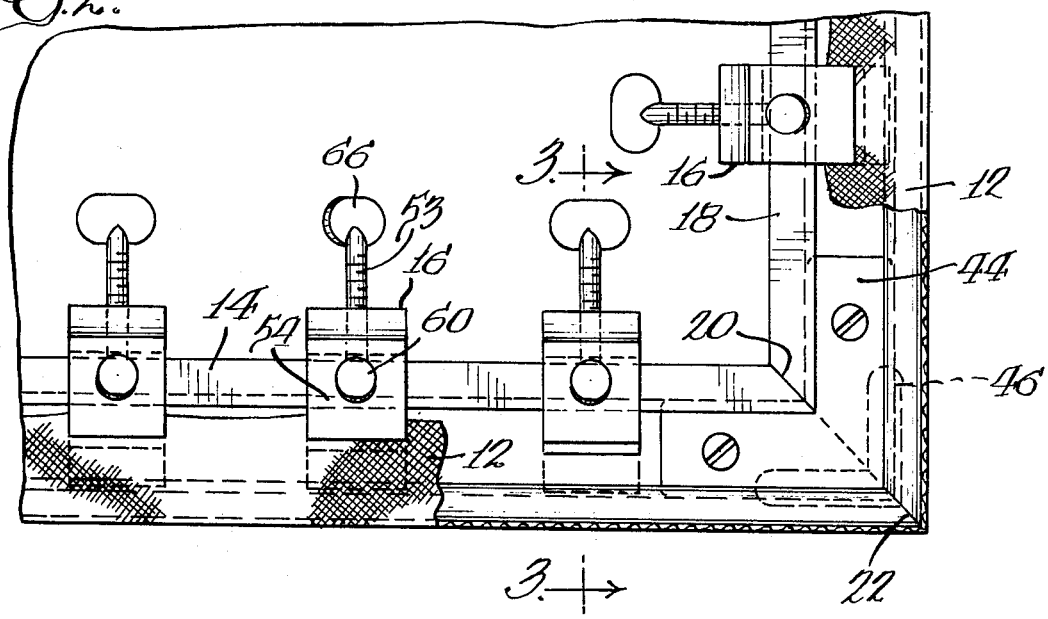
FIG. 2 is a greatly enlarged perspective view of one corner of the stretcher frame assembly with fragmentary portions of the canvas web broken away for ease of illustration.
Figure 4:
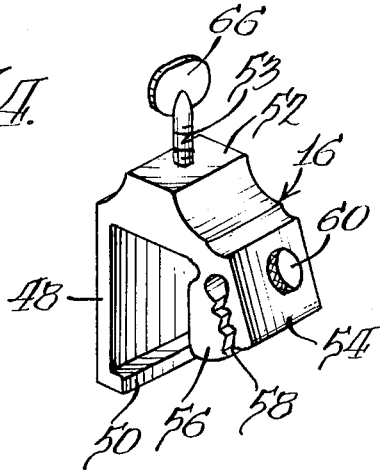
FIG. 4 is a perspective view of the clamp shown in FIG. 3.
Figure 6:
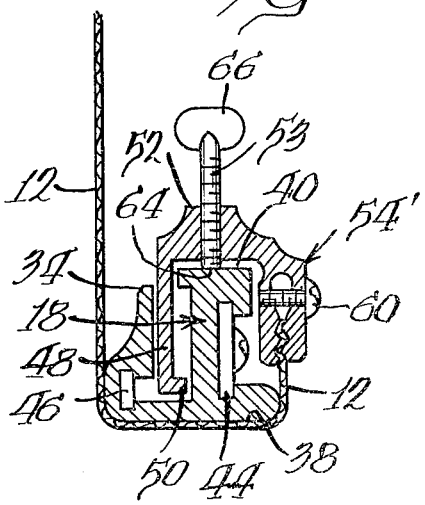
FIG. 6 is a cross-sectional view similar to FIG. 3, but illustrating a modified embodiment of the clamp in accordance with principles of the present invention.
Figure 7:
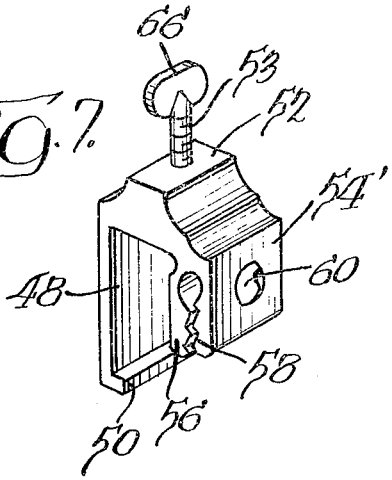
FIG. 7 is a perspective view of the clamp shown in FIG. 6.

The jaw member 54, coupling member 52 and guide 48 are integrally connected to form a unitary C-shaped clamp. In the preferred embodiment, as shown in FIGS. 3 and 4, the rearward end of jaw member is positioned at an approximate twenty degree angle with the coupling member to permit the jaw member to be positioned forwardly of the rearward end of the frame member's outer side wall 38, within the area bounded by the thickness of depth of the rectangular picture frame structure 14, to permit attachment of a cardboard member 62 or the like against the underside of the rectangular picture frame structure. The cardboard shields the back of the canvas from dust and dirt, absorbs the impact of accidental rearward blows and helps minimize fluctuating temperature and humidity. Portions of the cardboard may be perforated to provide for circulation of air. In the embodiment shown in FIGS. 6 and 7, the rearward end of the jaw member 54′ is perpendicular to the coupling member 52 and positioned rearwardly of the outer side wall 38.

The thumb screw 53 includes an outer end 64 and an inward manually-graspable head 66. The outer end is normally positioned against the inner side wall 40 of the frame member to fixedly position the clamp with respect to the stretcher frame assembly 10 and to space the coupling member inward of the inner side wall 40. The manually graspable head is spaced inwardly of the coupling member 52 toward the center of the rectangular picture frame structure 14 so that the coupling member is disposed between the inner side wall 40 and the manually graspable head.

In the stretcher frame assembly 10, the clamps 16 are spaced along the rectangular picture frame structure 14. For each of the frame members 18, the center of the corner clamps 16*a* are preferably positioned approximately 1 ½ inches from the center of the next adjacent clamp 16*b*, while the spacing between the centers of other clamps such as 16*c* are equidistant at 1 inch intervals. It is of course to be understood that any number of clamps may be used, as desired, and that spacing between clamps may be selectively varied.

Figure 9:
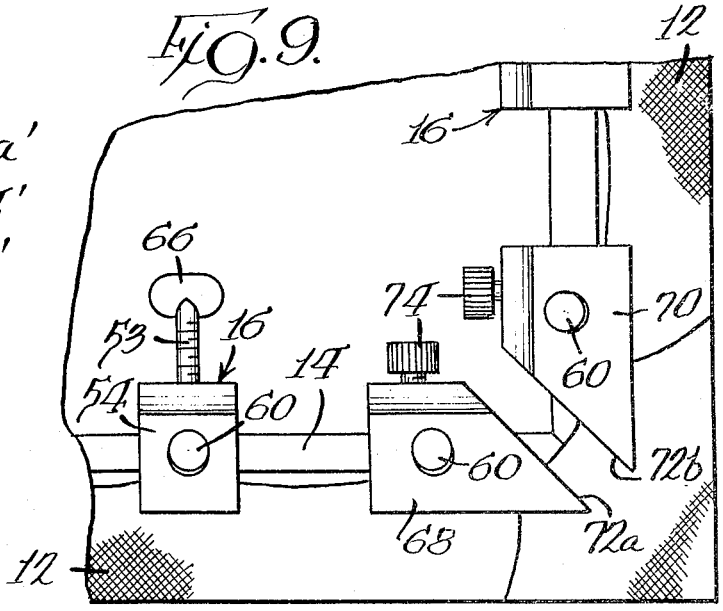
FIG. 9 is a view similar to FIG. 2 with the inclusion of corner clamps.

Referring to FIG. 9, the stretcher frame assembly can further be provided with a pair of corner clamps 68 and 70 at each corner of the rectangular frame structure to effect pinpoint localized stretching and contraction of each corner of the canvas web 12. The corner clamps are constructed and arranged identically to the clamps shown in FIGS. 3 and 4, except the sides 72*a* and 72*b* facing the corner are beveled or mitered at a 45° angle, and the thumbscrew 53 is replaced by a manually-graspable knurled cylindrical head screw 74 adjacent the coupling member so as to avoid interference and screw contact of the corner clamps.

Operation Of The Clamps

The clamps are independently operable of each other to facilitate localized grasping, stretching and contraction of the stretchable web 12. For each clamp, the manually-graspable screw or head screw 53 or 74 is rotated clockwise to move the web-grasping jaw member 54 inward, away from the attached frame member 18 and toward the center of the stretcher frame assembly 10, to effect localized stretching of the web. Counter-clockwise rotation of the thumb screw or head screw will move the web-grasping jaw member 54 toward the rectangular picture frame structure 14, to effect localized contraction of the web. The thumb and head screws should be rotated counterclockwise until the outer end 64 of the thumb screw no longer engages the frame member 18, when it is desired to slide the clamp along the frame member to a new position.

Wooden Stretcher Frame Assembly

Figure 8:
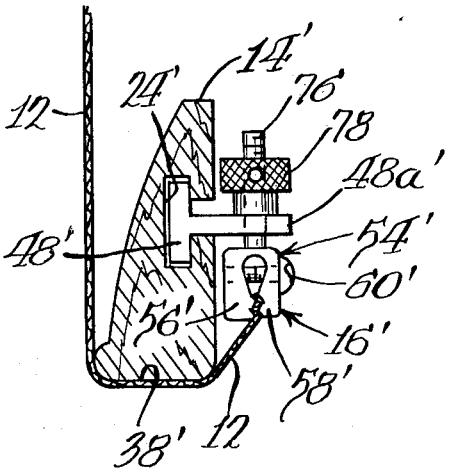
FIG. 8 is a cross-sectional view of a modified wooden stretcher frame assembly in accordance with the principles of the present invention.

When desired, a wooden rectangular picture frame structure 14′ with a T-shaped grooved clamp-receiving channel 24′ may be used, as shown in FIG. 8, with a modified clamp 16′. Each of the modified clamps are independently operable and include a T-shaped guide member 48' for slidably engaging the clamp-receiving channel.

The T-shaped guide member includes a base section 48a' extending out of the clamp-receiving channel. The base section is centrally threaded to receive an elongated threaded stem 76 fixedly attached to a jaw member 54'. A manually-graspable centrally threaded locknut 78 abuts against the base section and threadedly engages the elongated stem to effect inward and outward movement of the jaw member. The jaw member includes spaced forward and rearward serrated bifurcated fingers 56' and 58' for grasping the stretchable web. The bifurcated jaw fingers are centrally threaded to receive a clamp-screw or jaw-screw 60' which operates to vary the spacing between the bifurcated fingers when it is desired to remove or insert the stretchable web.

In operation, clockwise rotation of the manually-graspable control nut 78 will move the web-grasping jaw member 54' inward, toward the center of the wooden frame structure, to effect localized stretching of the web. Counter-clockwise rotation of the control nut 78 will move the web-grasping jaw member 54' outward, toward the wooden frame's outer side wall 38', to effect localized contraction of the web.

Although embodiments of the invention have been shown and described, it is to be understood that various modifications and substitutions may be made by those skilled in the art with out departing from the novel spirit and scope of the invention.

What is claimed and desired to be secured by Letters Patent of the United States are:

1. A frame assembly for holding a stretchable web, comprising in combination:

a plurality of elongated frame members with abutting mitered end portions cooperatively positioned to define a polygonal-shaped structure, each of the frame members having a cross-sectional configuration defining an elongated clamp-receiving channel; and a plurality of clamps permanently coupled to said polygonal-shaped structure, each of said clamps being independently operable of the other and including guide means for slidably engaging said clamp-receiving channel, jaw means for grasping the stretchable web, coupling means connecting the jaw means to the guide means and spaced inward from said frame members within the area bounded by the polygonal-shaped structure, and manually operable means abutting against said frame members and operatively connected to the coupling means for selectively adjusting the tension of the web so as to permit localized stretching and contraction of said web.

2. A frame assembly as in claim 1, wherein the polygonal-shaped structure includes corners, each corner having a first angle bracket and a second angle bracket fixedly connected thereto for rigidifying the polygonal-shaped structure, said frame members being of extruded metal with a cross-sectional configuration defining a first channel for receiving the first angle bracket and a second channel for receiving the second angle bracket.

3. A frame assembly as in claim 1, wherein the jaw means include spaced serrated bifurcated-fingers for grasping the stretchable web and screw means operatively connected to the bifurcated fingers for varying the spacing between said bifurcated fingers.

4. A frame assembly as in claim 1, wherein the jaw means are of a size and shape for accommodating positioning of said jaw means within the area bounded by the thickness or depth of said polygonal-shaped structure to permit attachment of a cardboard member or the like against the underside of said structure.

5. A frame assembly as in claim 1, wherein the clamp-receiving channel has a mouth and the guide means include a lip member confined with the clamp-receiving channel and of a greater size and dimension than the mouth of said clamp-receiving channel for preventing said clamp from being removed from said frame assembly.

6. A frame assembly as in claim 1 wherein the frame members define a rectangular structure, said manually operable means including thumb screw means threadedly engageable with the coupling means and abuttingly engaging the frame member for selectively varying the spacing between the coupling means and the frame member to effect movement of the jaw means with respect to the frame member so as to vary the tension to the stretchable web, said thumb screw means including a manually graspable head at the end of said thumb screw means positioned inward of the interior area defined by the cross-section of the frame members and within the area bounded by the rectangular structure.

7. A frame assembly as in claim 1 wherein the clamps are spaced from each other at selected distances, each clamp being independently operable to vary the spacing to the next adjacent clamp.

8. A frame assembly as in claim 1 wherein the frame members define a plurality of corners, said clamps including a pair of corner clamps disposed at each corner, each clamp having a mitered side facing the mitered end portions of the frame members with the manually operable means constructed and arranged to avoid interference and contact with the adjacent corner clamp.

9. A clamp for use with an artist's frame to hold a canvas web or the like having a tendency to expand and contract with changes of temperature and relative humidity, comprising:

guide means adapted to be operatively secured to the frame for slidably engaging said frame;

jaw means for grasping the canvas web;

coupling means connecting the jaw means to the guide means and adapted to be spaced inward of the frame within the area bounded by said frame; and manually operable means operatively connected to the coupling means and adapted to abut against the frame for selectively adjusting the tension of said web in response to the expansion or contraction of the web due to changes in the temperature and relative humidity so as to permit localized stretching of said web.

10. A clamp as in claim 9 wherein the jaw means are serrated for grasping the canvas web.

11. A clamp as in claim 9 with a mitered side adjacent a corner of the frame for selectively adjusting the tension of a corner of the web, said manually operable means including a manually graspable head adjacent said coupling means.

12. A clamp as in claim 9 wherein the jaw means include spaced bifurcated serrated-fingers of a size and shape for positioning at a distance from the main body of the canvas web no greater than the thickness of the frame to permit attachment of a cardboard backing member or the like against the underside of said frame behind said canvas web, and screw means operatively connected to the serrated-fingers for varying the spacing between said fingers.

13. A clamp as in claim 9 wherein the manually operable means includes thumb screw means threadedly engageable with the coupling means and adapted to abuttingly engage said frame for selectively varying the spacing between said frame and said coupling means so that movement of the jaw means with respect to the frame is effected to vary the tension of said web.

14. In a stretcher frame assembly for holding a stretchable web, comprising in combination:

a plurality of wooden elongated frame members cooperatively positioned to define a polygonal-shaped structure, each of the frame members having a cross-sectional configuration defining an elongated T-shaped clamp-receiving channel; and a plurality of clamps permanently coupled to said polygonal-shaped structure, each of said clamps being independently operable of the other and including a T-shaped guide member for slidably engaging said clamp-receiving channel with the T-shaped guide member providing an aperture-defining base section projecting out of said channel, an elongated threaded stem slidably engageable with the aperture-defining base section, jaw means fixedly attached to the threaded stem for grasping the stretchable web, and manually graspable nut means threadedly cooperating with the threaded stem and adjacent said aperture-defining base section for selectively adjusting the tension of the web so as to permit localized stretching and contraction of said web.

* * * * *